US005080734A

United States Patent [19]

Krueger et al.

[11] Patent Number: 5,080,734

[45] Date of Patent: Jan. 14, 1992

[54] HIGH STRENGTH FATIGUE CRACK-RESISTANT ALLOY ARTICLE

[75] Inventors: Daniel D. Krueger; Jeffrey F. Wessels, both of Cincinnati, Ohio

[73] Assignee: General Electric Company, Cincinnati, Ohio

[21] Appl. No.: 417,097

[22] Filed: Oct. 4, 1989

[51] Int. Cl.[5] ..... C22C 19/05; C22F 1/10

[52] U.S. Cl. ..... 148/410; 148/12.7 N; 148/428; 420/448

[58] Field of Search ..... 420/448; 148/410, 428, 148/12.7 N; 416/241 R; 419/28, 29; 75/245

[56] References Cited

U.S. PATENT DOCUMENTS

| | | | |
|---|---|---|---|
| Re. 29,920 | 2/1979 | Baldwin | 420/448 |
| 3,046,108 | 7/1962 | Eiselstein | 420/448 |
| 3,151,981 | 10/1964 | Smith et al. | 420/448 |
| 3,457,066 | 7/1969 | Pohlman et al. | 420/450 |
| 4,207,098 | 6/1980 | Shaw | 420/448 |
| 4,318,753 | 3/1982 | Anderson et al. | 148/3 |
| 4,765,956 | 8/1988 | Smith et al. | 420/445 |
| 4,769,087 | 9/1988 | Genereux | 148/2 |
| 4,820,358 | 4/1989 | Chang | 148/13 |

*Primary Examiner*—R. Dean
*Assistant Examiner*—Margery S. Phipps
*Attorney, Agent, or Firm*—Carmen Santa Maria; Jerome C. Squillaro

[57] ABSTRACT

Improved, high strength, fatigue crack-resistant nickel-base alloys for use at elevated temperatures are disclosed. The alloys are suitable for use as turbine disks in gas turbine engines of the type used in jet engines, or for use as hub sections of dual alloy turbine disks for advanced turbine engines, maintaining stability at engine operating temperatures up to about 1500° F. The alloy is characterized by a microstructure having an average grain size of from about 10 microns to 20 microns. Coarse and fine intragranular gamma prime particles are distributed throughout the grains, of sizes 0.15–0.2 microns and 15 nanometers, respectively. The grain boundaries are substantially free of gamma prime, but have carbides and borides. A method for achieving the desired properties in such turbine disks is also disclosed.

11 Claims, 12 Drawing Sheets

HIGH STRENGTH FATIGUE CRACK-RESISTANT ALLOY ARTICLE

CROSS REFERENCES TO RELATED APPLICATIONS

The following commonly assigned applications are directed to related subject matter and are being concurrently filed with the Present application, the disclosures of which are incorporated herein by reference:

Ser. No. 07/417,095
Ser. No. 07/417,096
Ser. No. 07/417,098

This application also relates generally to the subject matter of U.S. Pat. No. 4,888,064, which patent is assigned to the same assignee as the instant application. The text of this related patent is incorporated herein by reference.

This invention relates to gas turbine engines for aircraft, and more particularly to materials used in turbine disks which support rotating turbine blades in advanced gas turbine engines operated at elevated temperatures in order to increase performance and efficiency.

BACKGROUND OF THE INVENTION

Turbine disks used in gas turbine engines employed to support rotating turbine blades encounter different operating conditions radially from the center or hub portion to the exterior or rim portion. The turbine blades are exposed to high temperature combustion gases which rotate the turbine. The turbine blades transfer heat to the exterior portion of the disk. As a result, these temperatures are higher than those in the hub or bore portion. The stress conditions also vary across the face of the disk. Until recently, it has been possible to design single alloy disks capable of satisfying the varying stress and temperature conditions across the disk. However, increased engine efficiency in modern gas turbines as well as requirements for improved engine performance now dictate that these engines operate at higher temperatures. As a result, the turbine disks in these advanced engines are exposed to higher temperatures than in previous engines, placing greater demands upon the alloys used in disk applications. The temperatures at the exterior or rim portion may be 1500° F. or higher, while the temperatures at the bore or hub portion will typically be lower, e.g., of the order of 1000° F.

In addition to this temperature gradient across the disk, there is also a variation in stress, with higher stresses occurring in the lower temperature hub region, while lower stresses occur in the high temperature rim region in disks of uniform thickness. These differences in operating conditions across a disk result in different mechanical property requirements in the different disk portions. In order to achieve the maximum operating conditions in an advanced turbine engine, it is desirable to utilize a disk alloy having high temperature creep and stress rupture resistance as well as high temperature hold time fatigue crack growth resistance in the rim portion and high tensile strength, and low cycle fatigue crack growth resistance in the hub portion.

Current design methodologies for turbine disks typically use fatigue properties, as well as conventional tensile, creep and stress rupture properties for sizing and life analysis. In many instances, the most suitable means of quantifying fatigue behavior for these analyses is through the determination of crack growth rates as described by linear elastic fracture mechanics ("LEFM"). Under LEFM, the rate of fatigue crack propagation per cycle (da/dN) is a function which may be affected by temperature and which can be described by the stress intensity range, $\Delta K$, defined as $K_{max}-K_{min}$. $\Delta K$ serves as a scale factor to define the magnitude of the stress field at a crack tip and is given in general form as $\Delta K = f(\text{stress, crack length, geometry})$.

Complicating the fatigue analysis methodologies mentioned above is the imposition of a tensile hold in the temperature range of the rim of an advanced disk. During a typical engine mission, the turbine disk is subject to conditions of relatively frequent changes in rotor speed, combinations of cruise and rotor speed changes, and large segments of cruise component. During cruise conditions, the stresses are relatively constant resulting in what will be termed a "hold time" cycle. In the rim portion of an advanced turbine disk, the hold time cycle may occur at high temperatures where environment, creep and fatigue can combine in a synergistic fashion to promote rapid advance of a crack from an existing flaw. Resistance to crack growth under these conditions, therefore, is a critical property in a material selected for application in the rim portion of an advanced turbine disk.

For improved disks, it has become desirable to develop and use materials which exhibit slow, stable crack growth rates, along with high tensile, creep and stress-rupture strengths. The development of new nickel-base superalloy materials which offer simultaneously the improvements in and an appropriate balance of tensile, creep, stress-rupture, and fatigue crack growth resistance, essential for advancement in the aircraft gas turbine art, presents a sizeable challenge. The challenge results from the competition between desirable microstructures, strengthening mechanisms, and composition features. The following are typical examples of such competition: (1) a fine grain size, for example, a grain size smaller than about ASTM 10, is typically desirable for improving tensile strength but not creep/stress-rupture and crack growth resistance; (2) small shearable precipitates are desirable for improving fatigue crack growth resistance under certain conditions, while shear resistant precipitates are desirable for high tensile strength; (3) high precipitate-matrix coherency strain is typically desirable for good stability, creep-rupture resistance and probably good fatigue crack growth resistance; (4) generous amounts of refractory elements such as W, Ta or Nb can significantly improve strength, but must be used in moderate amounts to avoid unattractive increases in alloy density and to avoid alloy instability; (5) in comparison to an alloy having a low volume fraction of the ordered gamma prime phase, an alloy having a high volume fraction of the ordered gamma prime phase generally has increased creep/rupture strength and hold time resistance, but also increased risk of quench cracking and limited low temperature tensile strength.

Once compositions exhibiting attractive mechanical properties have been identified in laboratory scale investigations, there is also a considerable challenge in successfully transferring this technology to large full-scale production hardware, for example, turbine disks of diameters up to, but not limited to, 25 inches. These problems are well known in the metallurgical arts.

A major problem associated with full-scale processing of Ni-base superalloy turbine disks is that of cracking during rapid quench from the solution temperature.

This is most often referred to as quench cracking. The rapid cool from the solution temperature is required to obtain the strength required in disk applications, especially in the bore region. The bore region of a disk, however, is also the region most prone to quench cracking because of its increased thickness and thermal stresses compared to the rim region. It is desirable that an alloy for turbine disk applications in a dual alloy turbine disk be resistant to quench cracking.

Many of the current superalloys intended for use as disks in gas turbine engines operating at lower temperatures have been developed to achieve a satisfactory combination of high resistance to fatigue crack propagation, strength, creep and stress rupture life at these temperatures. An example of such a superalloy is found in the commonly-assigned application Ser. No. 06/907,276 filed Sept. 15, 1986. While such a superalloy is acceptable for rotor disks operating at lower temperatures and having less demanding operating conditions than .those of advanced engines, a superalloy for use in the hub portion of a rotor disk at the higher operating temperatures and stress levels of advanced gas turbines desirably should have a lower density and a microstructure having different grain boundary phases as well as improved grain size uniformity. Such a superalloy should also be capable of being joined to a superalloy which can withstand the severe conditions experienced in the rim portion of a dual alloy disk of a gas turbine engine operating at lower temperatures and higher stresses. It is also desirable that a complete rotor disk in an engine operating at lower temperatures and/or stresses be manufactured from such a superalloy.

As used herein, yield strength ("Y.S.") is the 0.2% offset yield strength corresponding to the stress required to produce a plastic strain of 0.2% in a tensile specimen that is tested in accordance with ASTM specifications E8 ("Standard Methods of Tension Testing of Metallic Materials," Annual Book of ASTM Standards, Vol. 03.01, pp. 130–150, 1984) or equivalent method and E21. The term ksi represents a unit of stress equal to 1,000 pounds per square inch.

The term "balance essentially nickel" is used to include, in addition to nickel in the balance of the alloy, small amounts of impurities and incidental elements, which in character and/or amount do not adversely affect the advantageous aspects of the alloy.

SUMMARY OF THE INVENTION

An object of the present invention is to provide a superalloy with sufficient tensile strength, fatigue resistance, creep strength and stress rupture strength for use in a turbine disk for a gas turbine engine. A further object of the present invention is to provide adequate resistance to quench cracking during processing.

Another object of this invention is to provide a superalloy having sufficient low cycle fatigue resistance as well as sufficient tensile strength to be used as an alloy for the hub portion of a dual alloy turbine disk of an advanced gas turbine engine and which is capable of operating at temperatures as high as about 1500° F.

Still another object of this invention is to provide a unitary turbine disk made from a superalloy having a composition as described herein and in accordance with the method described herein capable of operation at lower engine temperatures.

In accordance with the foregoing objects, the present invention is achieved by providing an alloy having a composition, in weight percent, of about 11.8% to about 18.2% cobalt, about 13.8% to about 17.2% chromium, about 4.3% to about 6.2% molybdenum, about 1.4% to about 3.2% aluminum, about 3.0% to about 5.4% titanium, about 0.9% to about 2.7% niobium, about 0.005% to about 0.040% boron, about 0.010% to about 0.090% zirconium, about 0.010% to about 0.090% carbon, and optionally, an element selected from the group consisting of hafnium and tantalum in an amount ranging from 0% to about 0.4% and the balance essentially nickel. The ranges of elements in the compositions of the present invention provide alloys which, when processed as described herein, are characterized by enhanced low cycle fatigue crack growth resistance and high strength at temperatures up to and including anticipated hub temperatures of about 1200° F.

Articles prepared from alloys in accordance with the present invention are resistant to cracking during severe quenching from temperatures above the gamma prime solvus into severe quench media such as salt or oil. Rapid quenching is necessary to develop the mechanical properties required for applications such as use as a turbine disk in a turbine engine. The gamma prime solvus temperature of a superalloy will vary depending upon the composition of the superalloy. As used herein, the term supersolvus temperature range is the temperature between the gamma prime solvus temperature above which the gamma prime phase dissolves substantially fully in the gamma matrix and a higher temperature above which incipient melting is sufficiently severe to have a significant adverse effect upon the properties of the superalloy. This supersolvus temperature range will vary from superalloy to superalloy at which the gamma prime phase is at the equilibrium of forming and dissolving within the gamma matrix.

Articles prepared in the above manner from the alloys of the invention exhibit a fatigue crack growth ("FCG") rate two or more times better than a commercially-available disk superalloy having a nominal composition of 13% chromium, 8% cobalt, 3.5% molybdenum, 3.5% tungsten, 3.5% aluminum, 2.5% titanium, 3.5% niobium, 0.03% zirconium, 0.03% carbon, 0.015% boron and the balance essentially nickel, at 750° F./20 cpm, 1000° F./20 cpm, 1200° F./20 cpm, and ten times better than this superalloy at 1200° F./90cpm using 1.5 second cyclic loading rates.

The alloys of the present invention can be used in various Powder metallurgy processes and may be used to make articles for use in gas turbine engines, for example, unitary turbine disks for gas turbine engines.

The alloys of this invention are particularly suited for use in the hub portion, also referred to as the bore portion, of a dual alloy disk for an advanced gas turbine engine, which require the properties displayed by this invention for use at temperatures as high as 1200° F.

Other features and advantages will be apparent from the following more detailed description of the invention, taken in conjunction with the accompanying drawings, which will illustrate, by way of example, the principles of the invention.

DETAILED DESCRIPTION OF THE INVENTION

Figure 1:
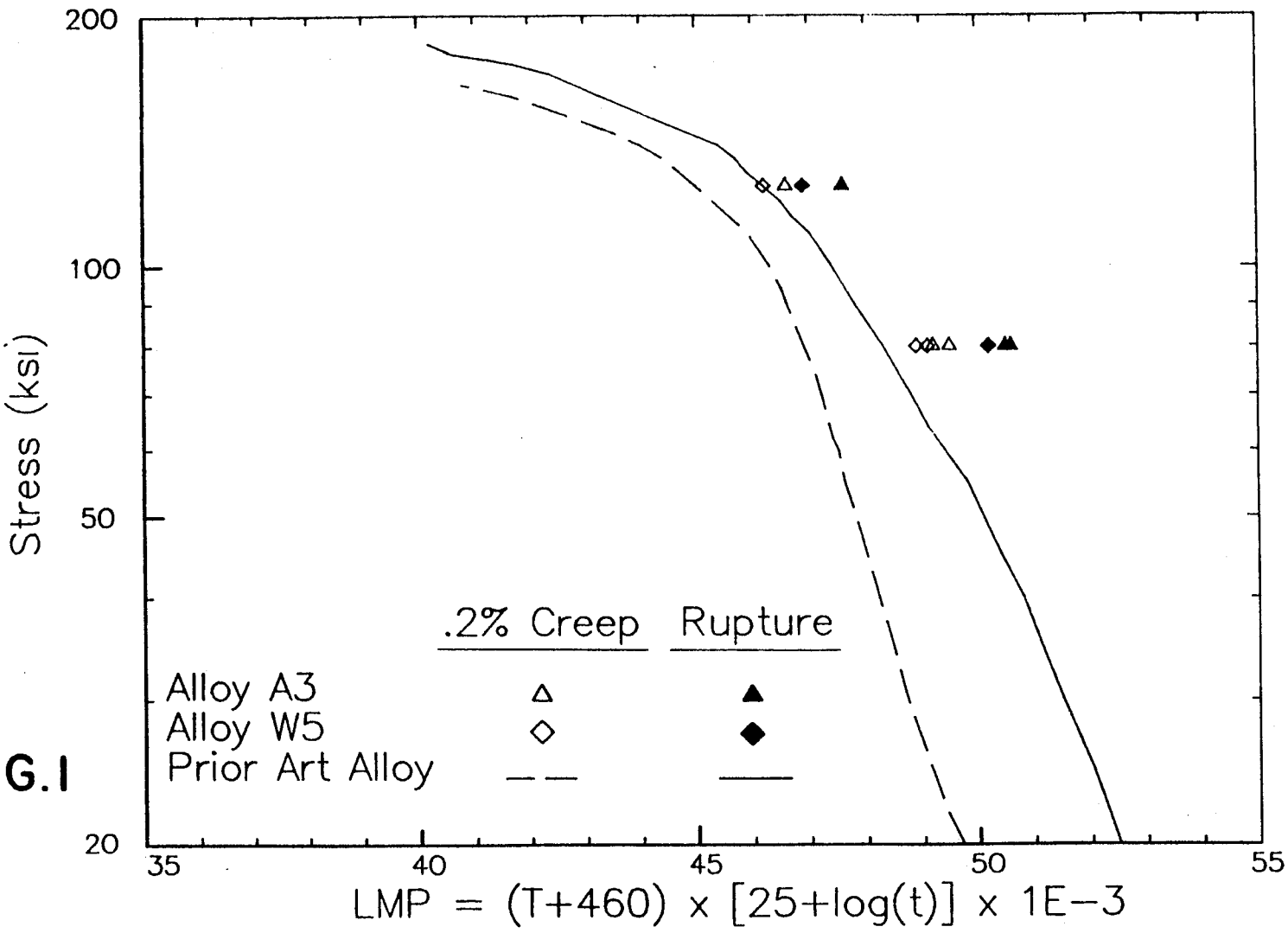
FIG. 1 is a graph of rupture strength versus the Larson-Miller Parameter for the alloys of the present invention as well as for a commercially-used disk superalloy.

Pursuant to the present invention, superalloys which have high tensile strength at elevated temperatures, excellent quench crack resistance, good fatigue crack resistance, good creep and stress rupture resistance as well as low density, are provided. The superalloys of the present invention, referred to as Alloy A3 and Alloy W5, were prepared by the compaction and extrusion of metal powder, although other processing methods, such as conventional powder metallurgy procedures, wrought processing or forging may be used.

The present invention also encompasses a method for processing the superalloys to produce material with a superior combination of properties for use in turbine disk applications, and more particularly, for use as a hub in an advanced dual alloy turbine disk. When used as a hub of an advanced turbine disk, as discussed in related application Ser. No. 07/417,096 and Ser. No. 07/417,096, the hub must be joined to a rim, which rim is the subject of related application Ser. No. 07/417,098. Thus, it is important for the alloys used in the hub and the rim to be compatible in terms of the following:

(1) chemical composition (e.g. no deleterious phases forming at the interface of the hub and the .rim);

(2) thermal expansion coefficients; and (3) dynamic modulus value.

It is also desirable that the alloys used in the hub and the rim be capable of receiving the same heat treatment while maintaining their respective characteristic properties. The alloys of the present invention satisfy those requirements when matched with the rim alloys of related application Ser. No. 07/417,098.

It is known that some of the most demanding properties for superalloys are those which are needed in connection with gas turbine construction. Of the properties which are needed, those required for the moving parts of the engine are usually greater than those required for static parts.

Quench crack resistance is a property which is necessary for a hub. It has been discovered that alloys having low-to-moderate volume fractions of gamma prime are more resistant to quench cracking than alloys having high volume fractions of gamma prime. It has been found that substitutions of niobium for aluminum tend to increase the quench crack susceptibility of these alloys, while substitutions of cobalt for nickel appear to decrease this susceptibility. Thus, the alloys of the present invention have relatively high levels of cobalt, but relatively low levels of niobium to enhance quench crack resistance while achieving other desired properties. The alloys of the present invention are resistant to quench cracking when quenched from above the gamma prime solvus temperature.

As previously noted, low-to-moderate volume fractions of gamma prime are desirable for quench crack resistance. It has also been determined that by increasing the (titanium+niobium+tantalum)/aluminum ratio of a base alloy and keeping other variables constant, both the tensile strength and the creep/rupture strength are increased when the alloy is processed by the compaction and extrusion method described. The degree to which this ratio can be increased, however, is limited by several factors. At a (titanium+tantalum+niobium)-/aluminum ratio of about 1.25 (calculated in atomic percent), for instance, the alloy becomes unstable and a needlelike or platelike hexagonally close-packed phase, designated as eta ($Ni_3Ti$) begins to precipitate during elevated temperature exposure. This phase is acceptable in small amounts, but becomes deleterious to mechanical properties when present in sufficient levels. Niobium and tantalum, although potent strengtheners, must also be limited to avoid undesirable density. Niobium is also undesirable because it has been found to increase the risk of quench cracking.

Additional elements can be added to inhibit the nucleation of the eta phase. Tungsten and molybdenum, for instance, can both reduce the tendency to nucleate the eta phase during elevated temperature exposure. These elements must also be limited, however, due to their unattractive effect on density. Carbon and boron tend to inhibit the nucleation of eta, but must also be limited due to the tendency to form carbides and borides which can be deleterious to mechanical properties when present in sufficient quantities.

The alloys of the present invention optimize the levels of the elements described above to obtain high strength and good fatigue crack growth while maintaining acceptable density and quench crack resistance.

Chromium contributes to the hot corrosion and oxidation resistance of the alloy by forming a $Cr_2O_3$-rich protective layer. Chromium also acts as a solid solution strengthener in the gamma matrix by substituting for nickel.

Aluminum is the principal alloying element in the formation of the gamma prime phase, $Ni_3Al$, although other elements such as titanium and niobium may substitute for aluminum in gamma prime. However, aluminum also contributes to creep resistance and stress rupture strength, as well as oxidation resistance by contributing to the formation of surface aluminum oxides.

Zirconium, carbon and boron as well as optional hafnium, are grain boundary strengthening elements. Because creep and rupture cracks propagate along grain boundaries, the presence of these elements strengthens grain boundaries and inhibits the mechanisms contributing to crack propagation.

The volume fraction of gamma prime of the alloy of the present invention, in order to satisfy the competing requirements of minimum density, high quench-crack resistance, superior low cycle fatigue crack resistance and high strength, is calculated to be between about 40% to about 50% The predicted volume fraction of gamma prime in Alloy A3 is about 47% and the predicted volume fraction of gamma prime in Alloy W5 is about 42.6%. Even though the volume fraction of gamma prime for these alloys is less than the volume fraction of gamma prime for the previously mentioned commercially-available disk superalloy which has a gamma prime volume fraction of about 50%, the density of the superalloys of this invention is lower than the previously mentioned commercially-available disk superalloy, which has a density of about 0.298 pounds per cubic inch.

The alloys of the present invention may be used as a single alloy disk because they can provide acceptable mechanical properties for use in such an application at lower temperatures. Use of the alloys of the present invention as a single alloy disk at lower temperatures still requires acceptable creep and stress rupture properties since the disk alloy must provide satisfactory mechanical properties across the disk. Although the creep and stress rupture characteristics of the hub alloy of a dual alloy disk are not as critical as for a rim alloy, it still must exhibit some resistance to creep and stress rupture in hub applications. The creep and stress rupture properties of the present invention are illustrated in the manner suggested by Larson and Miller (Transactions of the A.S.M.E., 1952, Volume 74, pages 765–771). The Larson-Miller method plots the stress in ksi as the ordinate and the Larson-Miller Parameter ("LMP") as the abscissa for graphs of creep and stress rupture. The LMP is obtained from experimental data by the use of the following formula:

$$LMP=(T+460)\times[25+log(t)]\times 10^{-3}$$

where

LMP = Larson-Miller Parameter

T = temperature in ° F.

t = time to failure in hours.

Using the design stress and temperature in this formulation together with a knowledge of the expected stress and temperature, it is possible to calculate either graphically or mathematically the design stress rupture life under these conditions. The creep and stress rupture strength of the alloys of the present invention are shown in FIG. 1. These properties are an improvement over the aforementioned commercially-available disk superalloy.

Crack growth or crack propagation rate is a function of the applied stress ($\sigma$) as well as the crack length (a). These two factors are combined to form the parameter known as stress intensity, K, which is proportional to the product of the applied stress and the square root of the crack length. Under fatigue conditions, stress intensity in a fatigue cycle represents the maximum variation of cyclic stress intensity, $\Delta K$, which is the difference between maximum and minimum K. At moderate temperatures, crack growth is determined primarily by the cyclic stress intensity, $\Delta K$, until the static fracture toughness $K_{IC}$ is reached. Crack growth rate is expressed mathematically as $$\frac{da}{dN}\ \alpha(\Delta K)^n$$

where

N = number of cycles n = constant, $2 \leqq n \leqq 4$

K = cyclic stress intensity a = crack length

The cyclic frequency and the temperature are significant parameters determining the crack growth rate. Those skilled in the art recognize that for a given cyclic stress intensity at an elevated temperature, a slower cyclic frequency can result in a faster fatigue crack growth rate. This undesirable time-dependent behavior of fatigue crack propagation can occur in most existing high strength superalloys at elevated temperatures.

The most undesirable time-dependent crack-growth behavior has been found to occur when a hold time is imposed at peak stress during cycling. A test sample may be subjected to stress in a constant cyclic pattern, but when the sample is at maximum stress, the stress is held constant for a period of time known as the hold time. When the hold time is completed, the cyclic application of stress is resumed. According to this hold time pattern, the stress is held for a designated hold time each time the stress reaches a maximum in following the cyclic pattern. This hold time pattern of application of stress is a separate criteria for studying crack growth and is an indication of low cycle fatigue life. This type of hold time pattern was described in a study conducted under contract to the National Aeronautics and Space Administration identified as NASA CR-165123 entitled "Evaluation of the Cyclic Behavior of Aircraft Turbine Disk Alloys", Part II, Final Report, by B. Cowles, J. R. Warren and F. K. Hauke, dated August 1980.

Depending on design practice, low cycle fatigue life can be considered to be a limiting factor for the components of gas turbine engines which are subject to rotary motion or similar periodic or cyclic high stress. If an initial, sharp crack-like flaw is assumed, fatigue crack growth rate is the limiting factor of cyclic life in turbine disks.

It has been determined that at low temperatures the fatigue crack propagation depends essentially entirely on the intensity at which stress is applied to components and parts of such structures in a cyclic fashion. The crack growth rate at elevated temperatures cannot be determined simply as a function of the applied cyclic stress intensity range $\Delta K$. Rather, the fatigue frequency can also affect the propagation rate. The NASA study demonstrated that the slower the cyclic frequency, the faster a crack grows per unit cycle of applied stress. It has also been observed that faster crack propagation occurs when a hold time is applied during the fatigue cycle. Time-dependence is a term which is applied to such cracking behavior at elevated temperatures where the fatigue frequency and hold time are significant parameters.

The fatigue crack growth resistance of the alloys of the present invention is highly improved over that of commercially available disk superalloys. In addition to fatigue crack growth testing at 750° F./20 cpm, (FIG. 2) 1000° F./20 cpm (FIG. 3) and 1200° F./20 cpm, (FIG. 4) hold time testing in order to evaluate hold time fatigue behavior using 90 second hold times and the same cyclic loading rates as the 20 cpm (1.5 seconds) tests was performed.

Tensile strength measured by the ultimate tensile strength ("U.T.S.") and yield strength ("Y.S.") must be adequate to meet the stress levels in the hub portion of a rotating disk. Although some of the tensile properties of the alloys of the present invention are slightly lower than the previously referred to commercially-available disk superalloy, the U.T.S. is adequate to withstand the stress levels encountered in the hub of advanced gas turbine engine disks and across the entire disk of gas turbine engines operating at lower temperatures, while additionally providing enhanced damage tolerance, creep/stress-rupture resistance and quench crack resistance.

In order to achieve the properties and microstructures of the present invention, processing of the alloys is important. Although a metal powder was produced which was subsequently processed using a compaction and extrusion method followed by a heat treatment, it will be understood to those skilled in the art that any method and associated heat treatment which produces the specified composition, grain size and microstructure may be used. For example, high quality alloy powders can be manufactured by a process which includes vacuum induction melting ingots of the composition of the present invention by conventional techniques, and subsequently atomizing the liquid composition in an inert gas atmosphere to produce powder. Such powder, preferably at a particle size of about 106 microns (0.0041 inches) and less is subsequently loaded under vacuum into a stainless steel can and sealed or consolidated by a compaction and extrusion process to yield a homogeneous, fully dense, fine-grained billet having two phases, a gamma matrix and a gamma prime precipitate. This process has been found to be successful in eliminating voids normally associated with the compaction of powders. Although a metal powder was produced which was subsequently processed using a compaction and extrusion method, any method which produces the specified composition having an appropriate grain size before solution treatment may be used.

The billet may preferably be forged into a preform using an isothermal closed die forging method at any suitable elevated temperature below the solvus temperature.

The alloy is then supersolvus solution treated at temperatures of at least about 2065° F., although 2065° F. to about 2110° F. for about 1 hour is preferred, quenched, and then aged at a temperature suitable to obtain stability of the microstructure when subjected to use at temperatures of about 1200° F. This quench preferably is performed at a rate as fast as possible without forming quench cracks while causing a uniform distribution of gamma prime throughout the structure. An aging treatment of about 1400° F.±25° F. for about 8 hours was found to provide such a stable microstructure for use at temperatures up to about 1350° F. Alternatively, the alloy can be machined into articles which are then given the above-described heat treatment. The alloy may also be aged at about 1500° F.±25° F. for about 4 hours to provide a stable microstructure for use at even higher temperatures (e.g., 1475° F.) The microstructure developed at this temperature is basically the same as that developed at 1400° F., but having slightly coarser gamma prime particles than the lower temperature aged microstructure.

The supersolvus solution treatment, quench and aging treatment at 1400° F. for these alloys typically yields a microstructure having an average grain size of about 10 to about 20 microns, although an occasional grain may be as large as about 40 microns in size. The grain boundaries are frequently decorated with gamma prime, carbide and boride particles. Intragranular gamma prime is approximately 0.1–0.3 microns in size. The alloys also typically contain fine-aged gamma prime approximately 15 nanometers in size uniformly distributed throughout the grains.

The alloys of the invention exhibit ultimate tensile strength ("U.T.S.") of about 238–246 ksi at room temperature, about 230–240 ksi at 1000° F., about 225–230 ksi at 1200° F. and about 165–174 ksi at 1400° F. The 0.2% offset yield strength ("Y.S.") is about 168–185 ksi at room temperatures, about 155–168 ksi at 1000° F., about 150–160 ksi at 1200° F., and about 144–158 ksi at 1400° F.

Solution treating may be performed at any temperature above the gamma prime solvus temperature and below the temperature at which significant incipient melting of the alloy occurs, and preferably to fully dissolve the gamma prime. The range of this supersolvus temperature will vary depending upon the actual composition of the alloy. For alloys of the disclosed compositions, the supersolvus temperature range extends from about at least 2040° F. to about 2250° F.

The following specific examples describe the alloys, articles and method of the present invention. They are intended for illustration purposes only and should not be construed as a limitation.

EXAMPLE 1

Twenty-five pound ingots of the following superalloy composition were prepared by a vacuum induction melting and casting procedure:

TABLE I

| | Composition of Alloy A3 | |
|---|---|---|
| | Wt. % | Tolerance Range in Wt. % |
| Co | 17.0 | ±1.0 |
| Cr | 15.0 | ±1.0 |
| Mo | 5.0 | ±0.5 |
| Al | 2.5 | ±0.5 |
| Ti | 4.7 | ±0.5 |
| Nb | 1.6 | ±0.5 |
| B | 0.030 | ±0.010 |
| C | 0.060 | ±0.020 |
| Zr | 0.060 | ±0.020 |
| Ni | Balance | |

A powder was then prepared by gas atomizing ingots of the above composition in argon. The powder was then sieved to remove powders coarser than 150 mesh. This resulting sieved powder is also referred to as −150 mesh powder.

The −150 mesh powder was next transferred to stainless steel consolidation cans. Initial densification of the alloy was performed using a closed die compaction at a temperature approximately 150° F. below the gamma prime solvus, followed by extrusion using a 7:1 extrusion reduction ratio at a temperature approximately 100° F. below the gamma prime solvus to produce fully dense fine grain extrusions.

The extrusions were then supersolvus solution treated at about 2100° F.±10° F., for about one hour. Supersolvus solution treatment substantially completely dissolves the gamma prime phase and forms a well-annealed structure. This solution treatment also recrystallizes and coarsens the fine-grained structure and permits controlled reprecipitation of the gamma prime during subsequent processing. The extrusions may be forged to any desired shape prior to quenching.

The solution-treated alloy was then rapidly cooled from the solution treatment temperature using a controlled fan helium quench. This quench was performed at a rate sufficient to develop a uniform distribution of gamma prime throughout the structure. The actual cooling rate was approximately 250° F. per minute.

Following quenching, the alloy was aged at about 1400° F.±25° F. for about 8 hours and then cooled in air. This aging promotes the uniform distribution of fine gamma prime.

Figure 5:
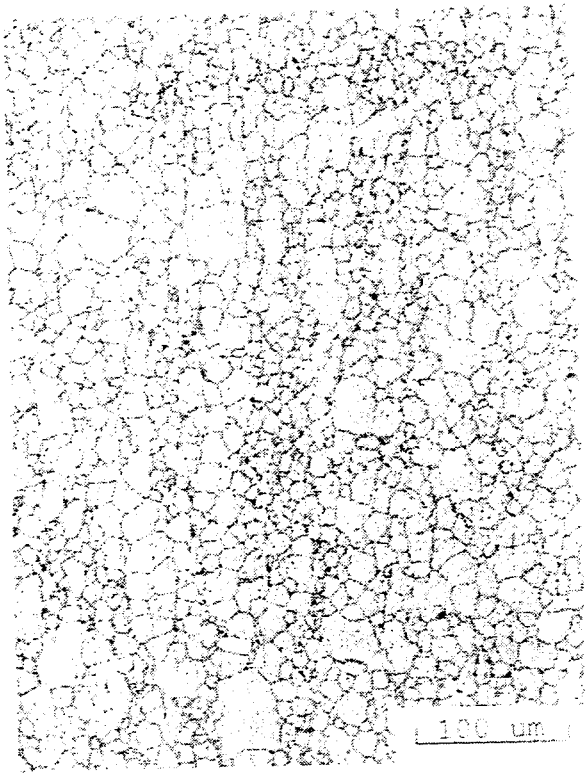
FIG. 5 is an optical photomicrograph of Alloy A3 at approximately 200 magnification after full heat treatment.
Figure 6:
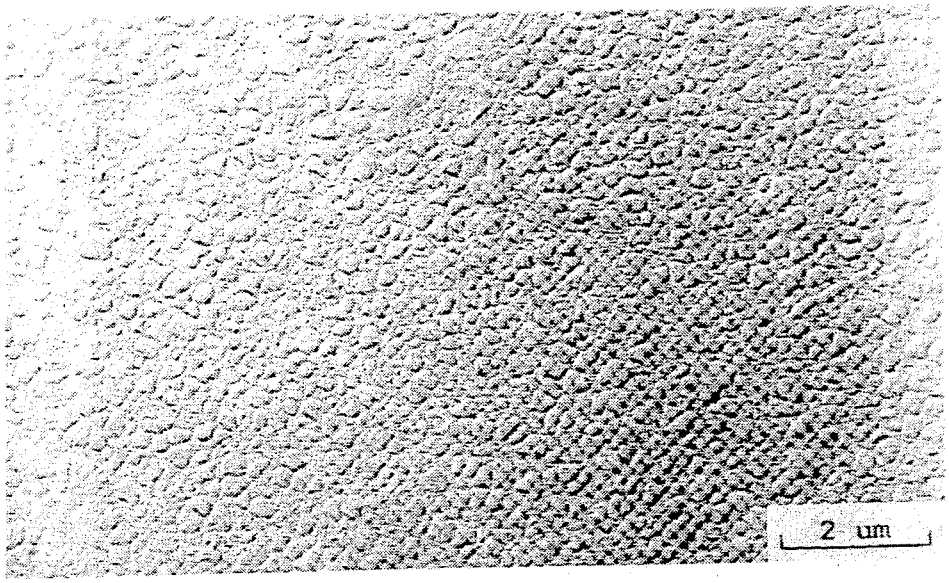
FIG. 6 is a transmission electron micrograph of a replica of Alloy A3 at approximately 10,000 magnification after full heat treatment.
Figure 7:
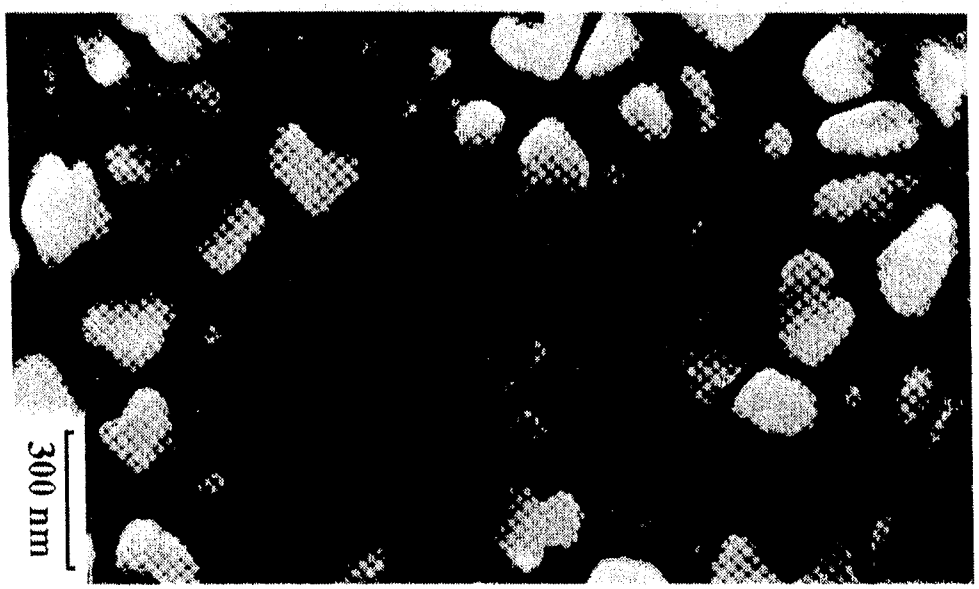
FIG. 7 is a dark field transmission electron micrograph of Alloy A3 at approximately 60,000 magnification after full heat treatment.

Referring now to FIGS. 5–7, the microstructural features of Alloy A3 after full heat treatment is shown. FIG. 5, a photomicrograph, shows that the average grain size is from about 10 to about 20 microns, although an occasional grain may be as large as about 40 microns in size. Gamma prime that nucleated early during cooling and subsequently coarsened, as well as carbide particles and boride particles are located at the grain boundaries. The intragranular gamma prime that formed on cooling is approximately 0.20 microns and is observable in FIG. 6 as the blocky particles and in FIG. 7 as the large white particles. Uniformly distributed fine gamma prime that formed during the 1400° F. aging treatment is approximately 15 nanometers in size and is observable in FIG. 7 as the fine white particles between the large white blocky particles.

Figure 2:
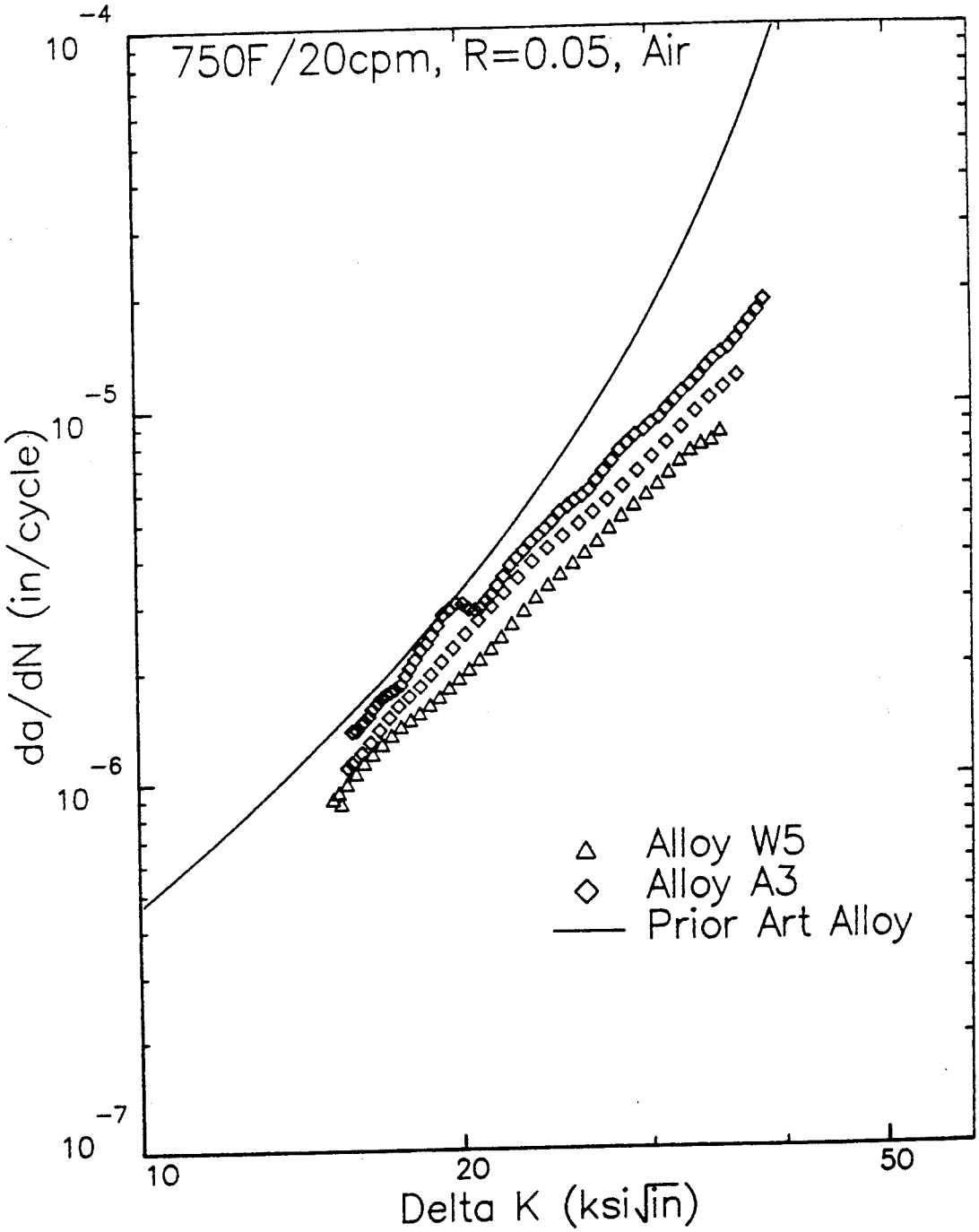
FIGS. 2–4 are graphs (log-log) of fatigue crack growth rates (da/dN) obtained at 750° F./20 cpm, 1000° F./20 cpm and 1200° F./20 cpm, respectively, at various stress intensity ranges (delta K) for Alloys A3 and W5.
Figure 3:
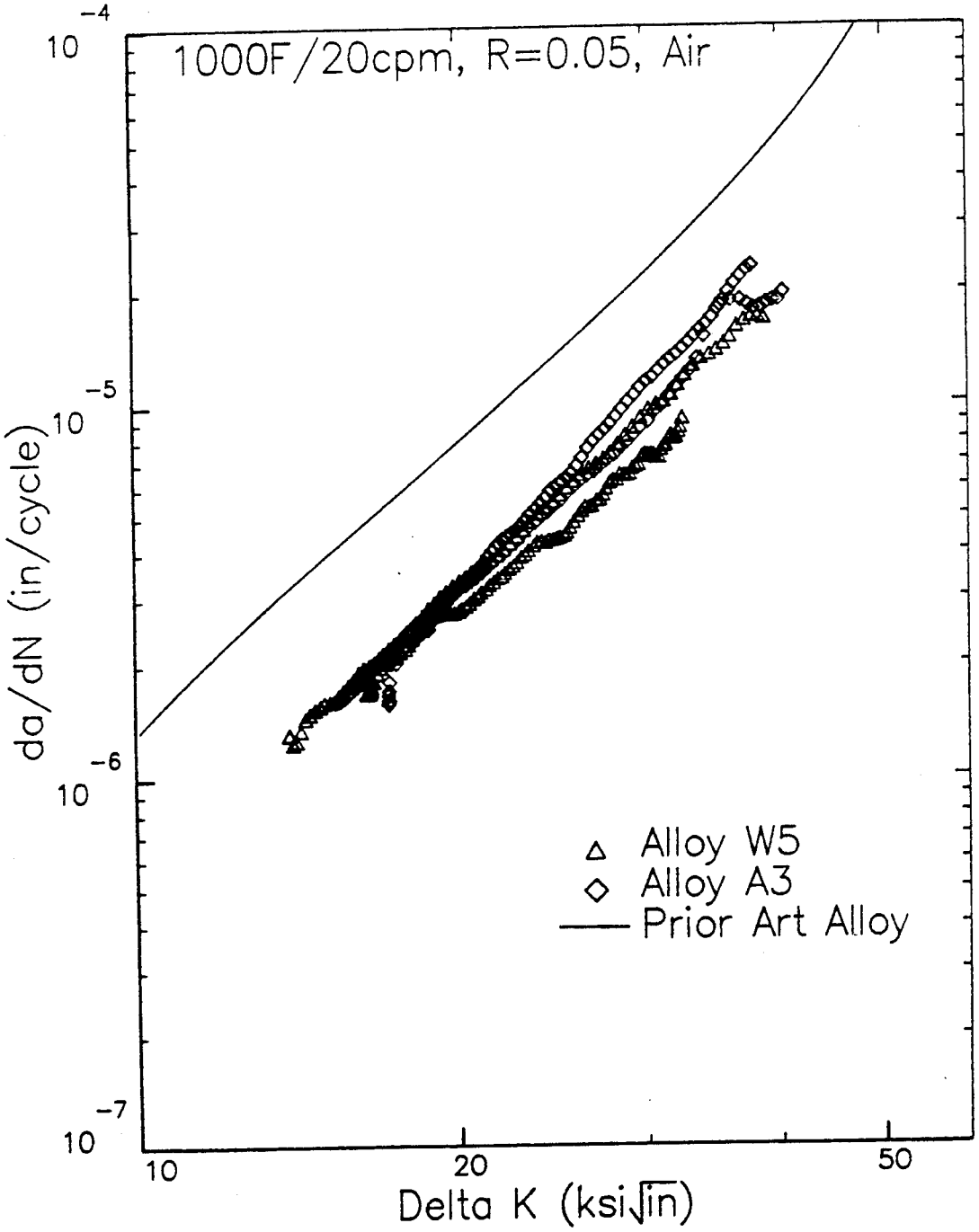
Figure 4:
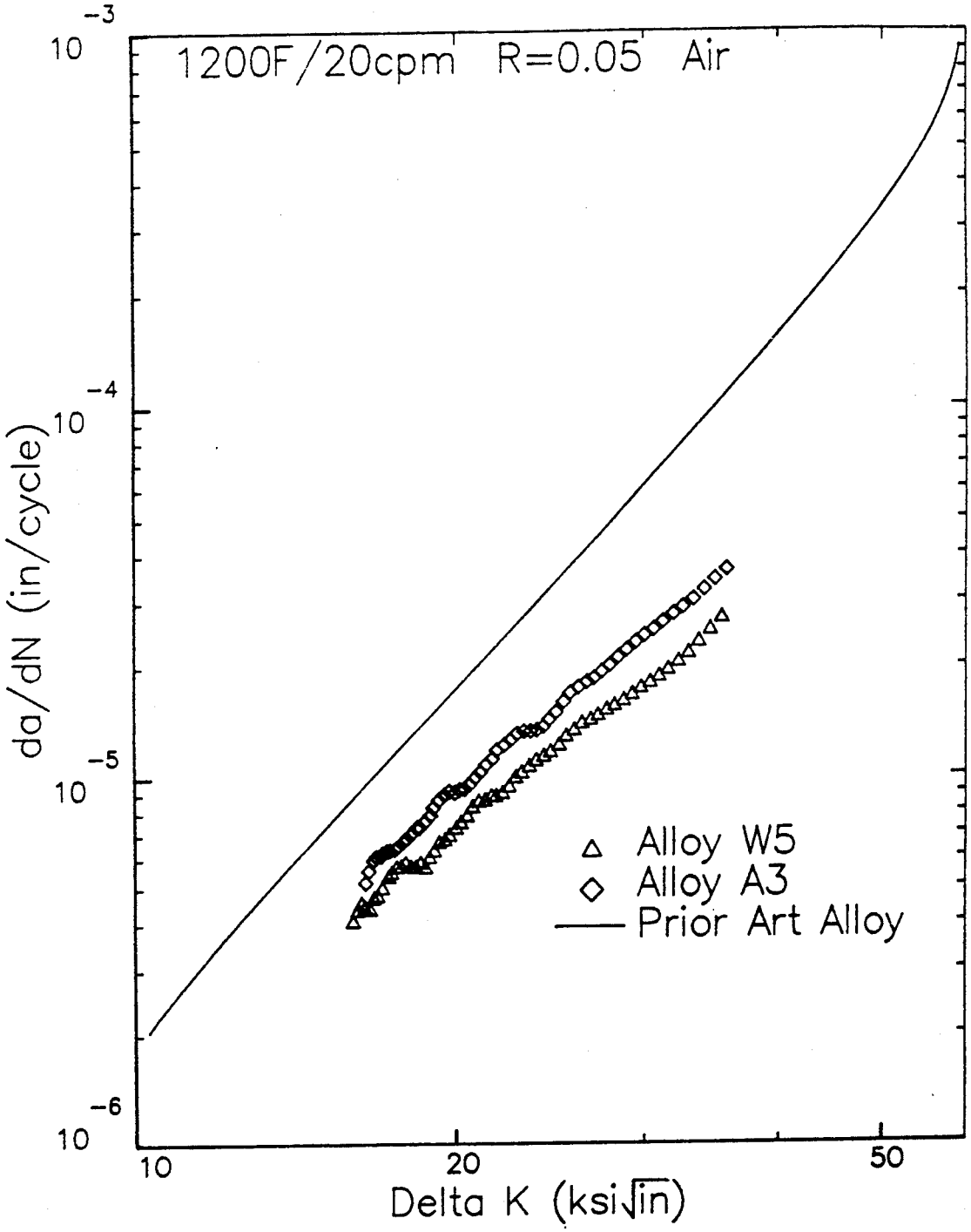
Figure 8:
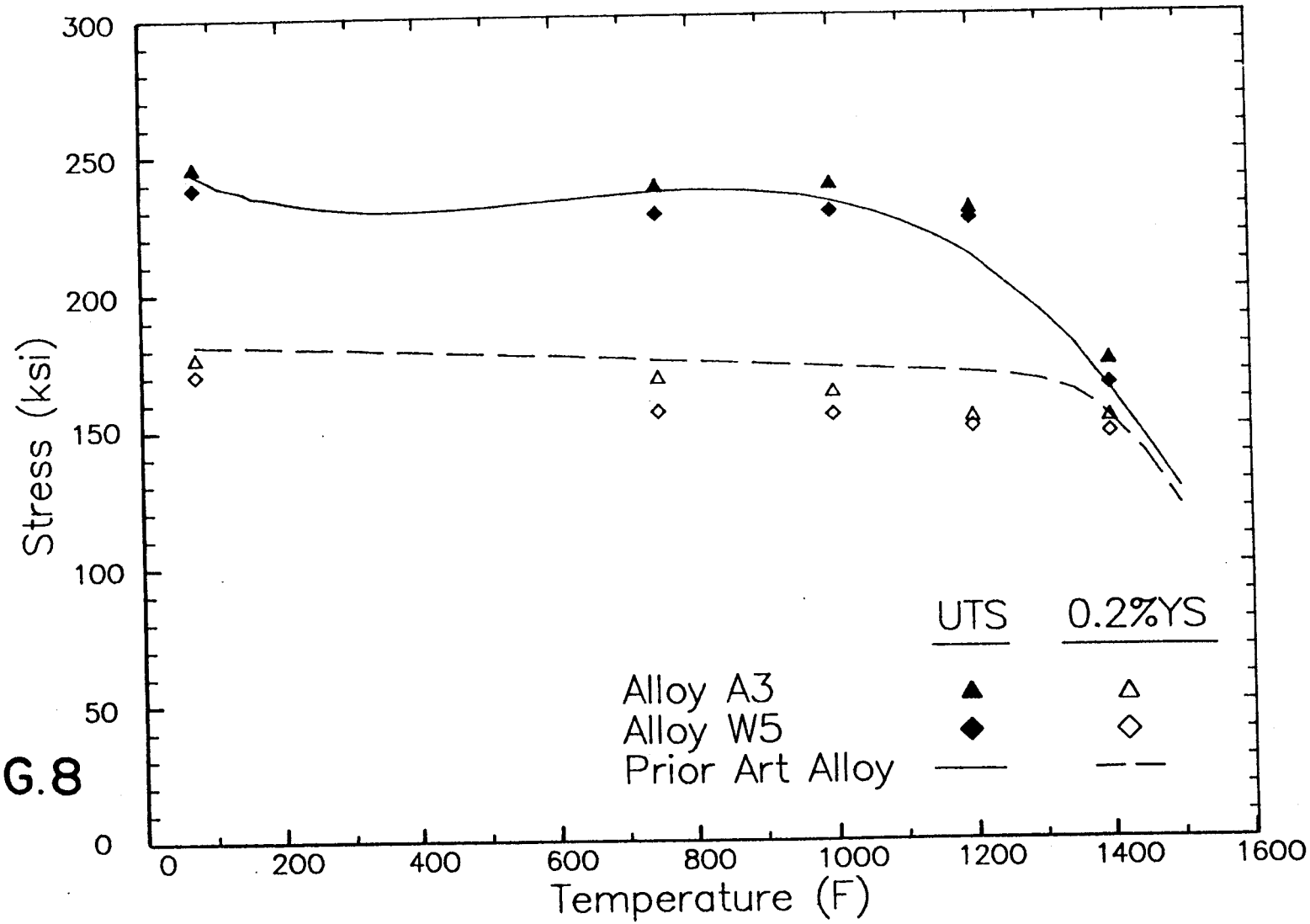
FIG. 8 is a graph in which ultimate tensile strength and yield strength (in ksi) of Alloys A3 and W5 are plotted as ordinates against temperatures (in degrees Fahrenheit) as abscissa.
Figure 9:
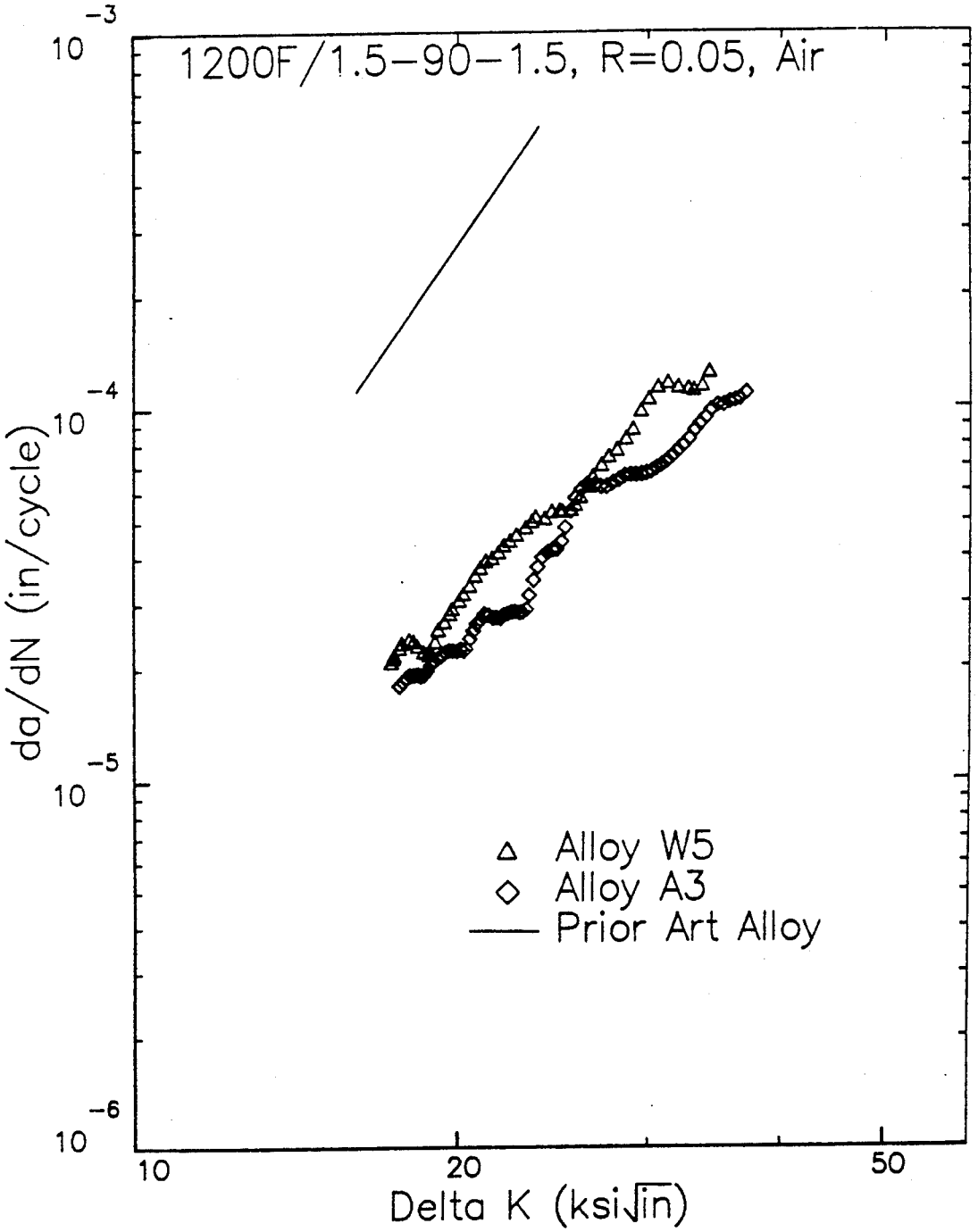
FIG. 9 is a graph (log-log) of fatigue crack growth rates (da/dN) obtained at 1200° F. using 90 second hold time for various stress intensity ranges ($\Delta K$) for Alloys A3 and W5.

FIGS. 2–4 are graphs of the fatigue crack growth behavior of Alloy A3 as compared to a commercially available disk superalloy at 750° F. (FIG. 2), 1000° F. (FIG. 3), and 1200° F. (FIG. 4) using triangular 0.33 hertz loading frequency. FIG. 9 is a graph of K vs da/dN of the low cycle fatigue crack growth behavior of Alloy A3 as compared to a commercially available disk superalloy at 1200° F. using 90 second hold times and 1.5 second cyclic loading rates. The fatigue crack growth behavior is significantly improved over this prior art disk superalloy. The creep and stress rupture properties of Alloy A3 are shown on FIG. 1. The tensile properties of Alloy A3 were determined and are listed in Table II. The U.T.S. and Y.S. data are plotted on FIG. 8. These strengths are compatible with the strength requirements of the hub portion of the dual alloy disk.

TABLE II

| Tensile Properties of Alloy A3 | | | | |
|---|---|---|---|---|
| 75° F. | 750° F. | 1000° F. | 1200° F. | 1400° F. |
| Ultimate Tensile Strength, ksi | | | | |
| 245.4 | 237.3 | 237.8 | 228.6 | 173.7 |
| 0.2% Yield Strength, ksi | | | | |
| 176.3 | 168.2 | 162.9 | 153.3 | 152.8 |
| Elongation, percent | | | | |
| 16.9 | 18.1 | 13.7 | 14.4 | 12.2 |
| Reduction of Area, percent | | | | |
| 26.9 | 24.9 | 15.8 | 21.7 | 21.2 |

When Alloy A3 is used as a hub in an advanced turbine, it must be combined with a rim alloy. These alloys must have compatible thermal expansion capabilities as well as compatible chemical compositions and dynamic moduli. When Alloy A3 is used as a single alloy disk in a turbine, the thermal expansion must be such that no interference with adjacent parts occurs when used at elevated temperatures. The thermal expansion behavior of Alloy A3 is shown in Table III; it may be seen to be compatible with the rim alloys described in related application Ser. No. 07/417,098.

TABLE III

| Alloy | Total Thermal Expansion (× 1.0E-3 in./in.) at Temperature °F. | | | | | | |
|---|---|---|---|---|---|---|---|
| | 75° F. | 300° F. | 750° F. | 1000° F. | 1200° F. | 1400° F. | 1600° F. |
| A3 | — | 1.4 | 4.9 | 6.9 | 8.7 | 10.8 | 13.2 |
| Prior Art Superalloy | — | 1.6 | 4.8 | 6.8 | 8.6 | 10.6 | — |

EXAMPLE 2

Twenty-five pound ingots of the following superalloy composition were prepared by a vacuum induction melting and casting procedure:

TABLE IV

| | Composition of Alloy W5 | |
|---|---|---|
| | Wt % | Tolerance Range in Wt % |
| Co | 13.0 | ±1.0 |
| Cr | 16.0 | ±1.0 |
| Mo | 5.5 | ±0.5 |
| Al | 2.1 | ±0.5 |
| Ti | 3.7 | ±0.5 |
| Nb | 2.0 | ±0.5 |
| B | 0.015 | ±0.010 |
| C | 0.030 | ±0.020 |
| Hf | 0.2 | ±0.1–0.2 |
| Zr | 0.030 | ±0.020 |
| Ni | bal. | |

A powder was then prepared by gas atomizing ingots of the above composition in argon. The powder was then sieved to remove powders coarser than 150 mesh. This resulting sieved powder is also referred to as −150 mesh powder.

The −150 mesh powder was next transferred to stainless steel consolidation cans where initial densification was performed using a closed die compaction procedure at a temperature approximately 150° F. below the gamma prime solvus, followed by extrusion using 7:1 extrusion reduction ratio at a temperature approximately 100° F. below the gamma prime solvus to produce fully dense extrusions.

The extrusions were then supersolvus solution treated in the temperature range of 2075° F.±10° F. for about 1 hour. Solution treatment in the supersolvus temperature range completely dissolves the gamma prime phase and forms a well-annealed structure. This solution treatment also recrystallizes and coarsens the fine-grain structure and permits controlled reprecipitation of the gamma prime during subsequent processing. The extrusions may be forged to any desired shape prior to quenching.

The solution-treated alloy was then rapidly cooled from the solution treatment temperature using a controlled fan helium quench. This quench was performed at a rate sufficient to develop a uniform distribution of intragranular gamma prime. The actual cooling rate in this quench was approximately 250° F. per minute. Following quenching, the alloy was aged at about 14000° F.±250° F. for about 8 hours and then static air cooled. This aging promotes uniform distribution of additional fine gamma prime.

Figure 10:
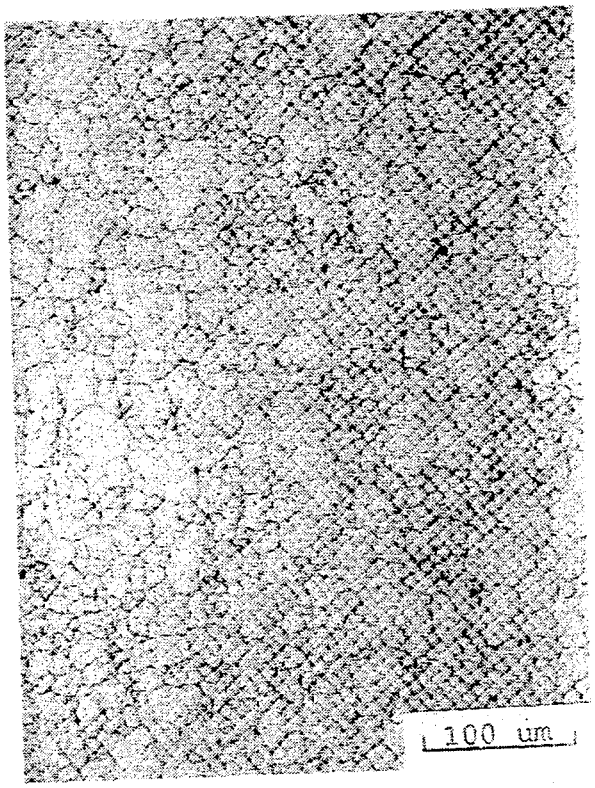
FIG. 10 is an optical photomicrograph of Alloy W5 at approximately 200 magnification after full heat treatment.
Figure 11:
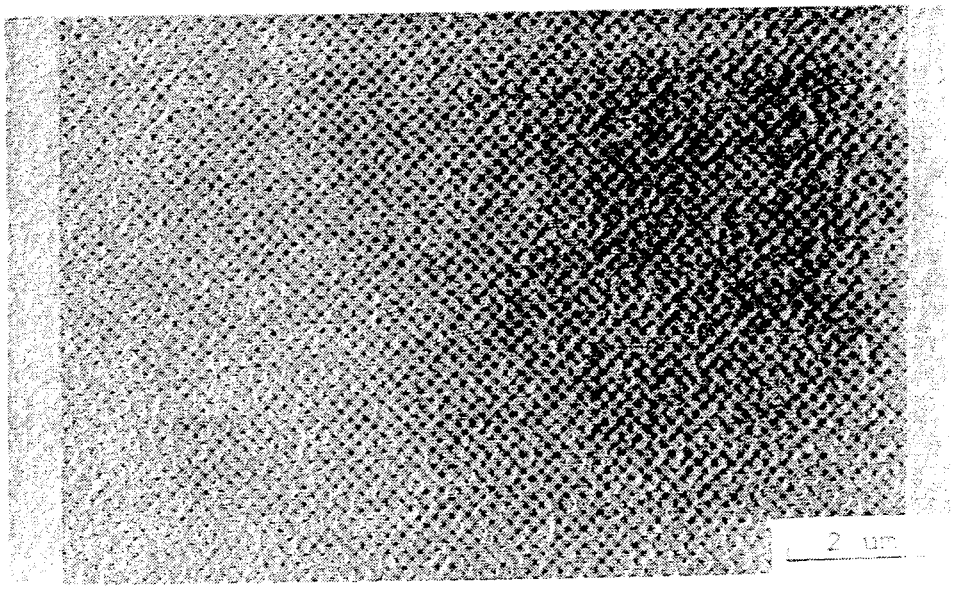
FIG. 11 is a transmission electron micrograph of a replica of Alloy W5 at approximately 10,000 magnification after full heat treatment.
Figure 12:
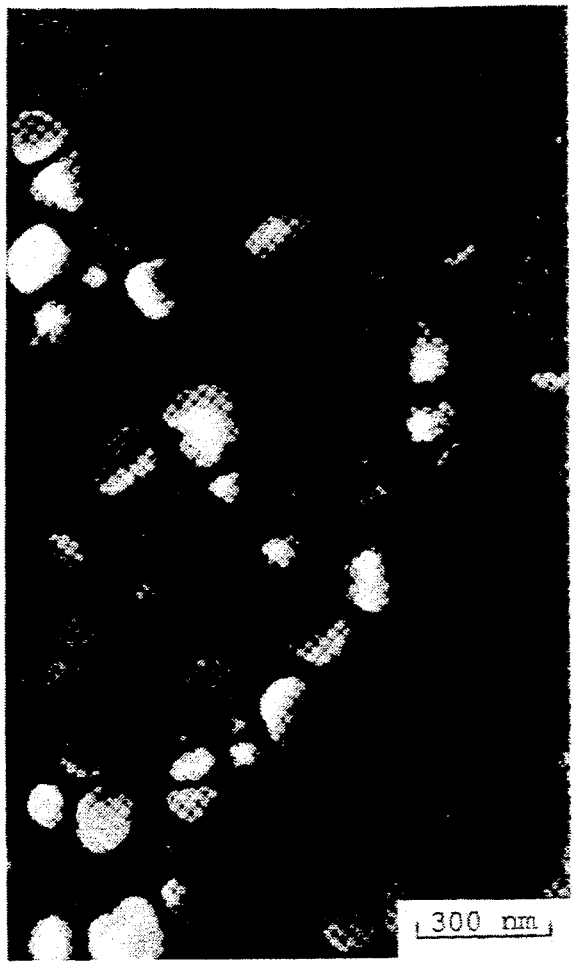
FIG. 12 is a dark field transmission electron micrograph of Alloy W5 at approximately 60,000 magnification after full heat treatment.

Referring now to FIGS. 10 through 12, the microstructural features of Alloy W5 after full heat treatment are shown. FIG. 10, a photomicrograph, shows that the average grain size is from about 10 to about 20 microns, although an occasional grain may be large as about 40 microns in size. The grain boundaries are decorated with gamma prime, carbide particles and boride particles. This intragranular gamma prime that formed on cooling is approximately 0.15 microns and is observable in FIGS. 11 and 12 as the cuboidal or blocky particles. In FIG. 12, this gamma prime is observable as the larger white particles. Uniformly distributed fine gamma prime that formed during the 1400° F. aging treatment is approximately 15 nanometers in size and is observable in FIG. 12 as fine white particles between the larger white blocky particles.

The tensile properties of Alloy W5 were determined and are listed below in Table V. The ultimate tensile strength ("UTS") and yield strength ("YS") of Alloy W5 are plotted on FIG. 8. Although these strengths are slightly lower than those of the prior art disk superalloy shown on FIG. 8, they are sufficient to satisfy the strength requirements of the hub portion of a dual alloy disk.

TABLE V

Tensile Properties of Alloy W5

| 75° F. | 750° F. | 1000° F. | 1200° F. | 1400° F. |
|---|---|---|---|---|
| | Ultimate Tensile Strength, ksi | | | |
| 238.1 | 227.7 | 228.3 | 225.4 | 165.4 |
| | 0.2% Yield Strength, ksi | | | |
| 170.6 | 156.3 | 155.0 | 150.1 | 147.6 |
| | Elongation, percent | | | |
| 16.8 | 15.7 | 15.3 | 16.8 | 10.3 |
| | Reduction of Area, percent | | | |
| 30.5 | 21.0 | 19.8 | 22.2 | 15.6 |

FIGS. 2 through 4 are graphs of the fatigue crack growth behavior of Alloy W5 as compared to the aforementioned commercially available disk superalloy at 750° F. (FIG. 2), 1000° F. (FIG. 3), and 1200° F. (FIG. 4) using 0.33 hertz loading frequency. FIG. 9 is a graph of the low cycle fatigue crack growth behavior of Alloy W5 as compared to this disk superalloy at 1200° F. using 90 second hold times and 1.5 second cyclic loading rates. The fatigue crack growth behavior is significantly improved over this disk superalloy. The creep and stress rupture properties of Alloy W5 are shown on FIG. 1.

When Alloy W5 is used as the hub in an advanced turbine disk, it must be combined with a rim alloy. These alloys must have compatible thermal expansion capabilities as well as compatible chemical compositions and dynamic moduli. When Alloy W5 is used alone as a dish in a gas turbine engine, the thermal expansion must be such that no interference with adjacent parts occurs when used at elevated temperatures. The thermal expansion behavior of Alloy W5 is shown in Table VI; it may be seen to be compatible with the rim alloys described in related application Ser. No. 07/417,098.

TABLE VI

| Alloy | Total Thermal Expansion (× 1.0E-3 in./in.) at Temperature. °F. | | | | | | |
|---|---|---|---|---|---|---|---|
| | 75° F. | 300° F. | 750° F. | 1000° F. | 1200° F. | 1400° F. | 1600° F. |
| W5 | — | 1.5 | 4.9 | 7.0 | 8.8 | 10.8 | 13.2 |
| Prior Art Superalloy | — | 1.6 | 4.8 | 6.8 | 8.6 | 10.6 | — |

EXAMPLE 3

Alloy A3 was prepared in a manner identical to that described in Example 1, above, except that, following quenching from the supersolvus solution treatment temperature, the alloy was aged for about four hours in the temperature range of about 1500° F. to about 1550° F. The tensile properties of Alloy A3 aged in this temperature range are given in Table VII. The creep-rupture properties for this Alloy aged at this temperature are given in Table VIII and the fatigue crack growth rates are given in Table IX.

TABLE VII

| Alloy A3 Tensile Properties (1525° F./4 Hour Age) | | |
|---|---|---|
| Temperature (°F.) | UTS (ksi) | YS (ksi) |
| 750 | 235.1 | 158 |
| 1400 | 164.4 | 145.8 |

TABLE VIII

| Alloy A3 Creep-Rupture Properties (1525° F./4 Hour Age) | | | | | |
|---|---|---|---|---|---|
| | | Time to (hours) | | Larson-Miller Parameter | |
| Temp. (°F.) | Stress (ksi) | 0.2% Creep | Rupture | 0.2% Creep | Rupture |
| 1400 | 80 | 10.0 | 89.1 | 48.4 | 50.1 |
| 1400 | 80 | 9.0 | 91.2 | 48.3 | 50.1 |

TABLE IX

| Alloy A3 Fatigue Crack Growth Rates (1525° F./4 Hour Age) | | | |
|---|---|---|---|
| | | da/DN Value at: | |
| Temp. (°F.) | Frequency | 20 ksi $\sqrt{in}$ | 30 ksi $\sqrt{in}$ |
| 1200 | 1.5-90-1.5 | 1.5E-05 | 4.00E-05 |

The microstructure of Alloy A3 aged for about four hours in the temperature range of about 1525° F. is the same as Alloy A3 aged for about eight hours at 1400° F. except that the gamma prime is slightly coarser, being about 0.15 to about 0.35 microns in size. The fine aged gamma prime is also slightly larger.

EXAMPLE 4

Alloy W5 was prepared in a manner identical to that described in Example 2, above, except that, following quenching from the supersolvus solution treatment temperature, the alloy was aged for about four hours in the temperature range of about 1500° F. to about 1500° F.

The tensile properties of Alloy W5 aged in this temperature range are given in Table X. The creep-rupture properties for this Alloy aged at this temperature are given in Table XI and the fatigue crack growth rates are given in Table XII.

TABLE X

| Alloy W5 Tensile Properties (1525° F./4 Hour Age) | | |
|---|---|---|
| Temperature (°F.) | UTS (ksi) | YS (ksi) |
| 750 | 222.8 | 143.6 |
| 1400 | 148.3 | 134.7 |

TABLE XI

| Alloy W5 Creep-Rupture Properties (1525° F./4 Hour Age) | | | | | |
|---|---|---|---|---|---|
| | | Time to (hours) | | Larson-Miller Parameter | |
| Temp. (°F.) | Stress (ksi) | 0.2% Creep | Rupture | 0.2% Creep | Rupture |
| 1400 | 80 | 1.5 | 48.8 | 46.8 | 49.6 |
| 1500 | 60 | 2.0 | 15.3 | 49.6 | 51.3 |

TABLE XII

| Alloy W5 Fatigue Crack Growth Rates (1525° F./4 Hour Age) | | | |
|---|---|---|---|
| | | da/DN Value at: | |
| Temp. (°F.) | Frequency | 20 ksi $\sqrt{in}$ | 30 ksi $\sqrt{in}$ |
| 750 | 20 cpm | 3.0E-06 | 8.0E-06 |
| 1000 | 20 cpm | 4.0E-06 | 1.0E-05 |
| 1200 | 1.5-90-1.5 | 2.0E-05 | 6.00E-05 |

The microstructure of Alloy W5 aged for about four hours in the temperature range of about 1525° F. is the same as Alloy W5 aged for about eight hours at 1400° F. except that the gamma prime is slightly coarser, being about 0.2 microns in size. The fine aged gamma prime is also slightly larger.

In light of the foregoing discussion, it will be apparent to those skilled in the art that the present invention is not limited to the embodiments and compositions herein described. Numerous modifications, changes, substitutions and equivalents will now become apparent to those skilled in the art, all of which fall within the scope contemplated by the invention herein.

What is claimed is:

1. A high strength, fatigue-resistant nickel base superalloy article, consisting essentially of, in weight percent: about 16% to about 18% cobalt, about 14% to about 16% chromium, about 4.5% to about 5.5% molybdenum, about 2% to about 3% aluminum, about 4.2% to about 5.2% titanium, about 1.1% to about 2.1% niobium, about 0.020% to about 0.040% boron, about 0.040% to about 0.80% carbon, about 0.040% to about 0.080% zirconium and the balance essentially nickel, the article characterized by a microstructure having an average grain size of from about 10 microns to about 20 microns, with coarse intragranular gamma prime with a size of about 0.2 microns uniformly distributed throughout the grains, and fine intragranular gamma prime with a size of about 15 nanometers also uniformly distributed throughout the grains, the article further characterized by a microstructure having carbides and borides located at the grain boundaries, the grain boundaries being substantially free of gamma prime.

2. The article of claim 1 which has been supersolvus solution treated in the temperature range of about 2090° F. to 2110° F. for about 1 hour, followed by a rapid quench, followed by an aging treatment at a temperature of about 1400° F.±25° F. for about 8 hours.

3. The article of claim 1 which has been supersolvus solution treated in the temperature range of about 2090° F. to 2110° F. for about 1 hour, followed by a rapid quench, followed by an aging treatment at a temperature of about 1525° F.±25° F. for about 4 hours.

4. The article of claim 3 wherein said article is the hub portion of a turbine disk for a gas turbine engine.

5. A fatigue resistant nickel-base superalloy article consisting essentially of, in weight percent: about 12% to about 14% cobalt, about 15% to about 17% chromium, about 5.0% to about 6.0% molybdenum, about 1.6% to about 2.6% aluminum, about 3.2% to about 4.2% titanium, about 1.5% to about 2.5% niobium, about 0.005% to about 0.025% boron, about 0.010% to about 0.050% carbon, about 0.010% to about 0.050% zirconium, optionally an element selected from the group consisting of hafnium and tantalum from 0% to about 0.3% and the balance essentially nickel, the article characterized by a microstructure having an average grain size of from about 10 microns to about 20 microns, with coarse intragranular gamma prime with a size of about 0.15 microns uniformly distributed throughout the grains, and fine intragranular gamma prime with a size of about 15 nanometers also intragranular gamma prime with a size of about 15 nanometers also uniformly distributed throughout the grains, the article further characterized by a microstructure having carbides and borides located at the grain boundaries, the grain boundaries being substantially free of gamma prime.

6. The article of claim 5 which has been supersolvus solution treated in the temperature range of about 2065° F. to 2085° F. for about 1 hour, followed by a rapid quench, followed by an aging treatment at a temperature of about 1400° F.±25° F. for about 8 hours.

7. The article of claim 6 which has been supersolvus solution treated in the temperature range of about 2065° F. to 2085° F. for about 1 hour, followed by a rapid quench, followed by an aging treatment at a temperature of about 1525° F.±25° F. for about 4 hours.

8. The article of claim 7 wherein said article is the hub portion of a turbine disk for a gas turbine engine.

9. The article of claim 3 or claim 7 wherein said article is a turbine disk for a gas turbine engine.

10. An article for use in a gas turbine engine prepared in accordance with claims 2 or 6.

11. The article of claim 10 wherein said article is a turbine disk for a gas turbine engine.

* * * * *